US010954616B2

(12) United States Patent
Kato

(10) Patent No.: US 10,954,616 B2
(45) Date of Patent: Mar. 23, 2021

(54) EMBROIDERY FRAME TRANSPORT DEVICE AND EMBROIDERY FRAME

(71) Applicant: BROTHER KOGYO KABUSHIKI KAISHA, Nagoya (JP)

(72) Inventor: Kiyomi Kato, Ama (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 351 days.

(21) Appl. No.: 16/107,265

(22) Filed: Aug. 21, 2018

(65) Prior Publication Data

US 2018/0355534 A1 Dec. 13, 2018

Related U.S. Application Data

(63) Continuation of application No. PCT/JP2017/001894, filed on Jan. 20, 2017.

(30) Foreign Application Priority Data

Mar. 15, 2016 (JP) ..... JP2016-051352

(51) Int. Cl.
*D05C 9/04* (2006.01)
*D05C 9/06* (2006.01)
(Continued)

(52) U.S. Cl.
CPC ..... *D05C 9/06* (2013.01); *D05B 39/00* (2013.01); *D05C 3/02* (2013.01); *D05C 9/04* (2013.01)

(58) Field of Classification Search
CPC ..... D05C 9/04; D05C 1/02; D05B 39/00
See application file for complete search history.

(56) References Cited

U.S. PATENT DOCUMENTS 8,327,782 B2 12/2012 Tseng et al.
2006/0011122 A1 1/2006 Yoshida
(Continued)

FOREIGN PATENT DOCUMENTS

JP 2006-14800 A 1/2006
JP 2006-34561 A 2/2006

OTHER PUBLICATIONS

Apr. 25, 2017 Search Report issued in International Patent Application No. PCT/JP2017/001894.
(Continued)

*Primary Examiner* — Tajash D Patel
(74) *Attorney, Agent, or Firm* — Oliff PLC

(57) ABSTRACT

An embroidery frame transport device includes a carriage, a guide portion, a rotation shaft, and a lock release lever including a first restricting portion and a contact portion. The lock release lever is configured to rotate to a first position and a second position around the rotation shaft. The first restricting portion contacts the coupling portion to restrict an embroidery frame from moving in a removing direction by moving to the first position when the embroidery frame is moved in a mounting direction in a process of mounting the coupling portion on the carriage. The contact portion contacts the coupling portion and presses the embroidery frame in the removing direction as a result of the lock release lever moving to a third position when the lock release lever is rotated in a releasing direction while the coupling portion is mounted on the carriage.

7 Claims, 11 Drawing Sheets

(51) Int. Cl.
*D05B 39/00* (2006.01)
*D05C 3/02* (2006.01)

(56) References Cited

U.S. PATENT DOCUMENTS

| | | | | |
|---|---|---|---|---|
| 2008/0141915 | A1 | 6/2008 | Bowlus | |
| 2015/0225882 | A1* | 8/2015 | Ihira | D05B 39/00 112/102.5 |
| 2018/0320300 | A1* | 11/2018 | Kawaguchi | D05B 39/00 |
| 2018/0371662 | A1* | 12/2018 | Fujihara | D05B 39/00 |

OTHER PUBLICATIONS

Sep. 18, 2018 International Preliminary Report on Patentability issued in International Patent Application No. PCT/JP2017/001894.

* cited by examiner

EMBROIDERY FRAME TRANSPORT DEVICE AND EMBROIDERY FRAME

CROSS-REFERENCE TO RELATED APPLICATION

This application is a continuation application of International Application No. PCT/JP2017/001894, filed Jan. 20, 2017, which claims priority from Japanese Patent Application No. 2016-051352, filed on Mar. 15, 2016. The disclosure of the foregoing application is hereby incorporated by reference in its entirety.

BACKGROUND

The present disclosure relates to an embroidery frame transport device that is configured to transport an embroidery frame and to an embroidery frame.

An embroidery frame transport device is known that is used by being mounted on a sewing machine capably of embroidery sewing. The known embroidery frame transport device includes an engagement mechanism and a lock mechanism. The engagement mechanism disengagably engages a coupling portion of an embroidery frame with a carriage, and stops the coupling portion of the embroidery frame that has moved in a sliding direction at a predetermined position with a locking portion. The lock mechanism is supported on the carriage. A lock member can be switched between a press position that presses the coupling portion of the embroidery frame against the locking portion, and a release position that releases the pressing.

SUMMARY

With the known embroidery frame transport device, removing the embroidery frame from the embroidery frame transport device is troublesome because it requires that a user perform an operation of switching the lock member of the lock mechanism to the release position, as well as perform an operation of pulling out the embroidery frame in a predetermined direction.

Various embodiments of the broad principles derived herein provide an embroidery frame transport device and an embroidery frame in which the embroidery frame can be attached to and detached from the embroidery frame transport device by a simpler operation compared to the related art.

Embodiments provide an embroidery frame transport device that includes a carriage, a guide portion, a rotation shaft, and a lock release lever. The carriage is configured to detachably mount with a coupling portion of an embroidery frame. The guide portion is provided on the carriage. The guide portion is configured to define a mounting direction and a removing direction of the embroidery frame. The rotation shaft is provided at a position facing the guide portion of the carriage. The lock release lever includes a first restricting portion and a contact portion. The lock release lever is configured to rotate to a first position and a second position around the rotation shaft. The first restricting portion contacts the coupling portion to restrict the embroidery frame from moving in the removing direction by moving to the first position when the embroidery frame is moved in the mounting direction in a process of mounting the coupling portion on the carriage. The contact portion contacts the coupling portion and presses the embroidery frame in the removing direction as a result of the lock release lever moving to a third position between the first position and the second position when the lock release lever is rotated in a releasing direction toward the second position from the first position while the coupling portion is in a state mounted on the carriage.

Embodiments further provide an embroidery frame that includes a first frame, a second frame, and a coupling portion. The second frame is configured to hold together with the first frame, a sewing object. The coupling portion is coupled together with the second frame. The coupling portion is configured to be mounted on a carriage of an embroidery frame transport device. The coupling portion includes a guide portion and an inclined portion. The guide portion is configured to define a mounting direction of the embroidery frame by contacting the carriage. The inclined portion extends along the mounting direction and inclines on the guide portion side toward the mounting direction.

BRIEF DESCRIPTION OF THE DRAWINGS

Embodiments will be described below in detail with reference to the accompanying drawings in which.

DETAILED DESCRIPTION

Figure 1:
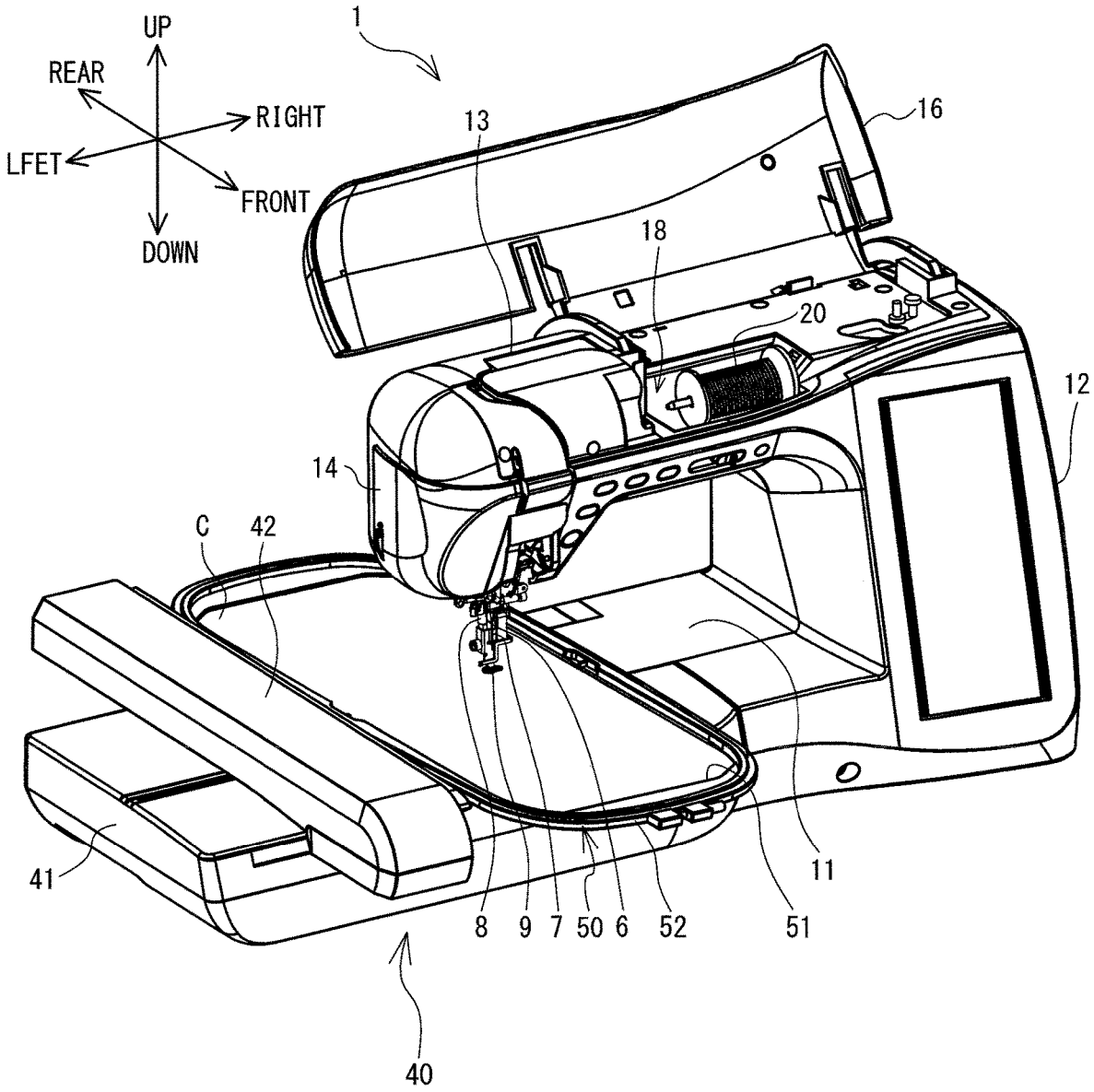
FIG. 1 is a perspective view of a sewing machine on which an embroidery frame transport device is mounted.

An embodiment of the present disclosure will be explained with reference to the drawings. A physical configuration of a sewing machine 1 on which an embroidery frame transport device (hereinafter referred to as the device) 40 is mounted will be explained with reference to FIG. 1 and FIG. 2. The up-down direction, the lower right side, the upper left side, the lower left side and the upper right side of FIG. 1 respectively correspond to the up-down direction, the front side, the rear side, the left side and the right side of the sewing machine 1 on which the device 40 is mounted. The longitudinal direction of a bed portion 11 and an arm portion 13 is the left-right direction of the sewing machine 1, and the side on which a pillar 12 is disposed is the right side. The extending direction of the pillar 12 is the up-down direction of the sewing machine 1.

Figure 2:
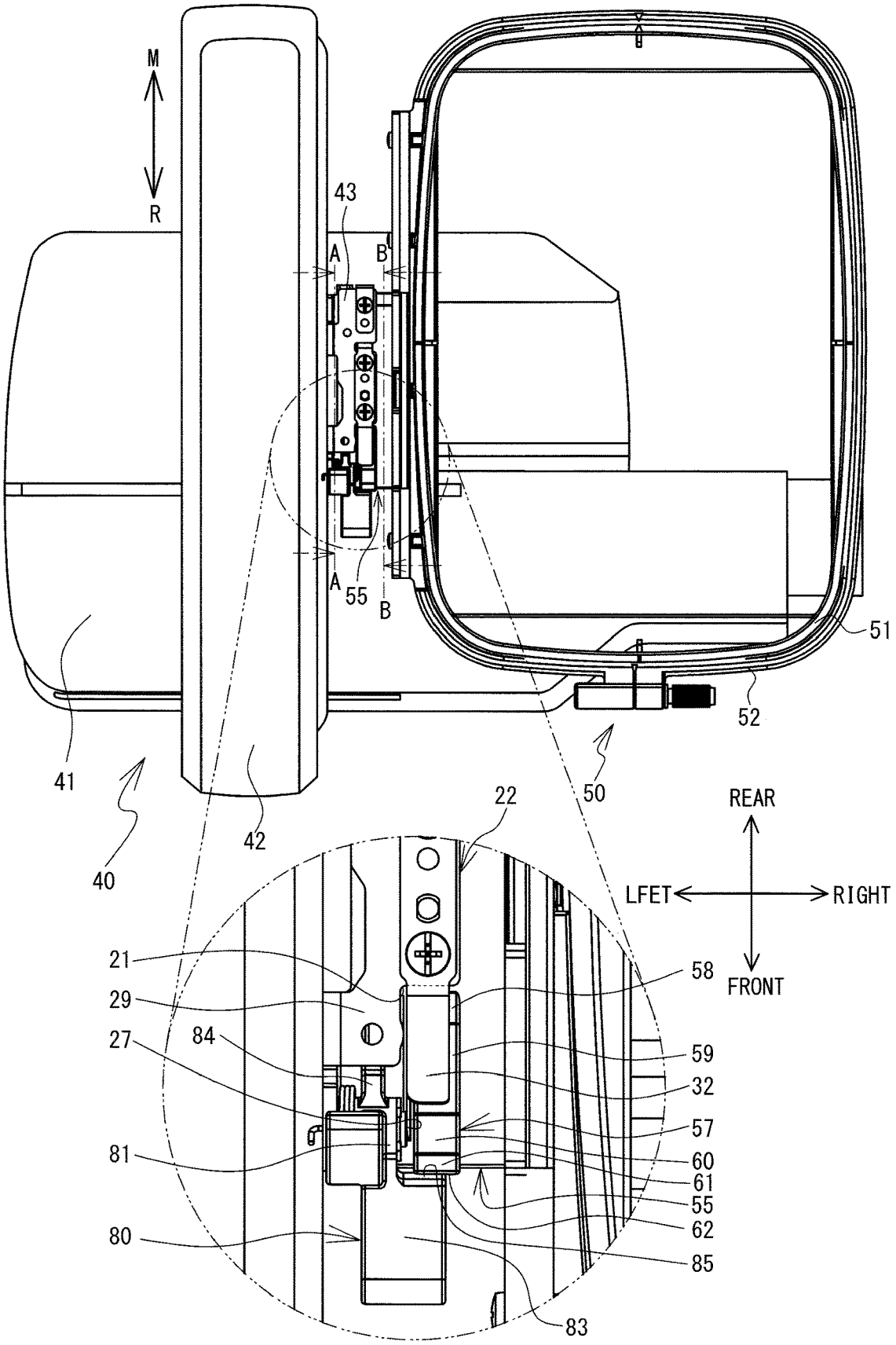
FIG. 2 is a plan view of the embroidery frame transport device in which an embroidery frame is arranged in a mounting position.

As shown in FIG. 1 and FIG. 2, the device 40 is configured to be removably mounted on the sewing machine 1. As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 is provided so as to extend upward from the right end portion of the bed portion 11. The arm portion 13 faces the bed portion 11 and extends to the left from the upper end of the pillar 12. The head portion 14 is coupled to the left leading end portion of the arm portion 13.

A feed dog, a feed mechanism, a shuttle mechanism and the like, which are not shown in the drawings, are provided inside the bed portion 11 of the sewing machine 1. When normal sewing that is not embroidery sewing is performed, the feed dog is driven by the feed mechanism and moves the sewing object by a predetermined movement amount. The shuttle mechanism entwines an upper thread (not shown in the drawings) with a lower thread (not shown in the drawings) below a needle plate (not shown in the drawings) that is provided on an upper surface of the bed portion 11. The pillar 12 is internally provided with a sewing machine motor (not shown in the drawings). An upper portion of the arm portion 13 is provided with a cover 16 that can open and close. FIG. 1 shows the sewing machine 1 when the cover 16 is in an open state. A thread housing portion 18 is provided below the cover 16 (namely, inside the arm portion 13). The thread housing portion 18 can house a thread spool 20 around which the upper thread is wound. A drive shaft (not shown in the drawings) that extends in the left-right direction is provided inside the arm portion 13. The drive shaft is rotationally driven by the sewing machine motor. The head portion 14 is provided with a needle bar 6, a presser bar 8, and the like. The sewing needle 7 is detachably mounted on the lower end of the needle bar 6. A pressor foot 9 is detachably attached to the lower end portion of the presser bar 8. The needle bar 6 is driven in the up-down direction by the rotation of the drive shaft.

As shown in FIG. 1 and FIG. 2, the movement mechanism 40 is configured to relatively move a sewing object C, which is held by an embroidery frame 50, with respect to the needle bar 6. The movement mechanism 40 is provided with a main body portion 41 and a carriage 42. The carriage 42 is provided with a holder 43, a Y axis movement mechanism (not shown in the drawings) and a Y axis motor (not shown in the drawings). The holder 43 is provided on the right side surface of the carriage 42. The embroidery frame 50 is configured to be mounted on and removed from the holder. The Y axis movement mechanism causes the holder 43 to move in the front-rear direction (a Y axis direction). The Y axis motor is configured to drive the Y axis movement mechanism. The holder 43 will be explained in detail later.

The main body portion 41 is internally provided with an X axis movement mechanism (not shown in the drawings) and an X axis motor (not shown in the drawings). The X axis movement mechanism causes the carriage 42 to move in the left-right direction (an X axis direction). The X axis motor is configured to drive the X axis movement mechanism. When embroidery sewing is performed using the embroidery frame 50, the movement mechanism 40 is configured to move the embroidery frame 50 mounted on the carriage 42 (more specifically, on the frame holder) to a position indicated by an XY coordinate system (an embroidery coordinate system) specific to the embroidery frame 50.

Figure 3A:
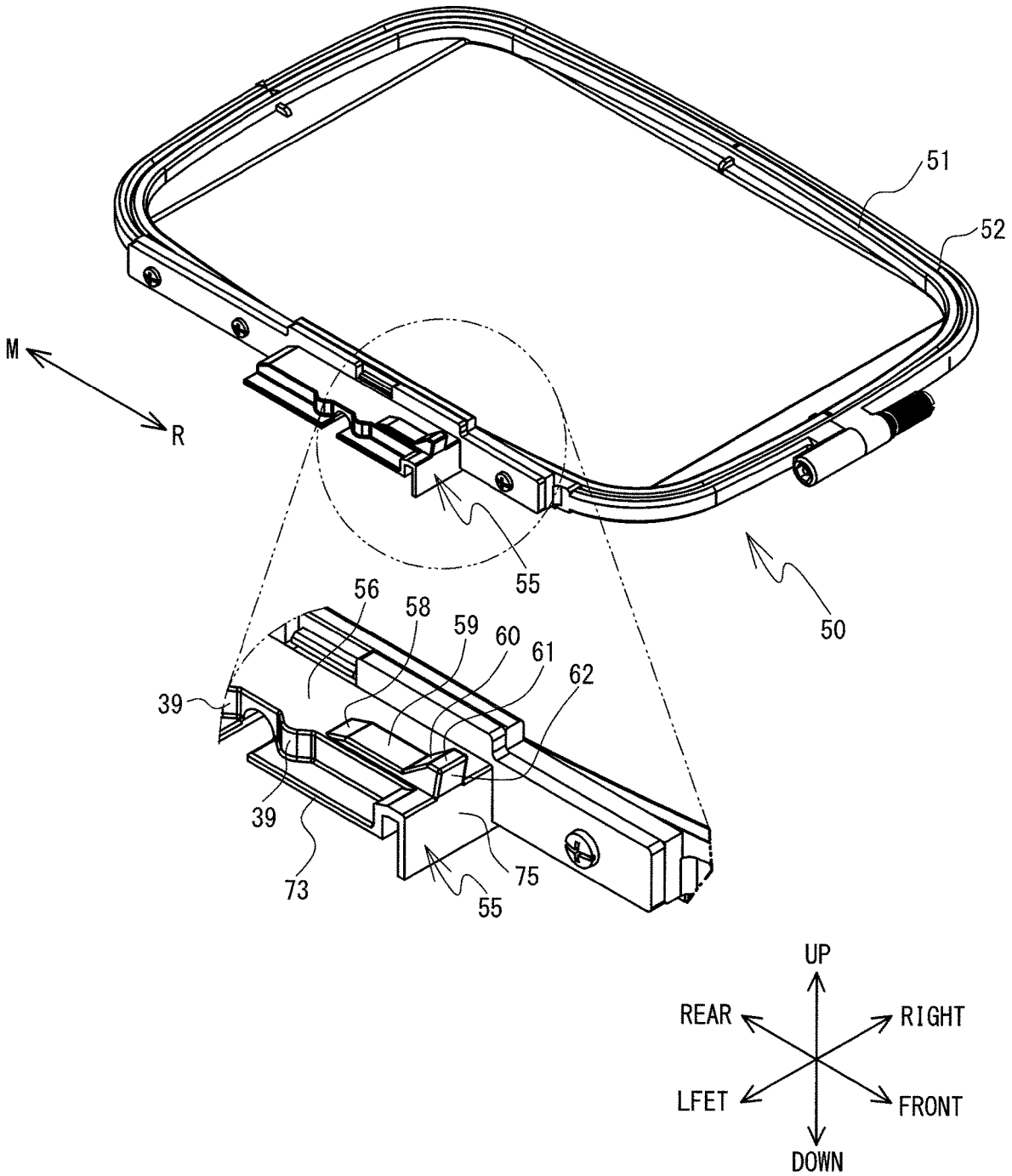
FIG. 3A is a perspective view of the embroidery frame and an enlarged perspective view of a coupling portion of the embroidery frame.
Figure 3B:
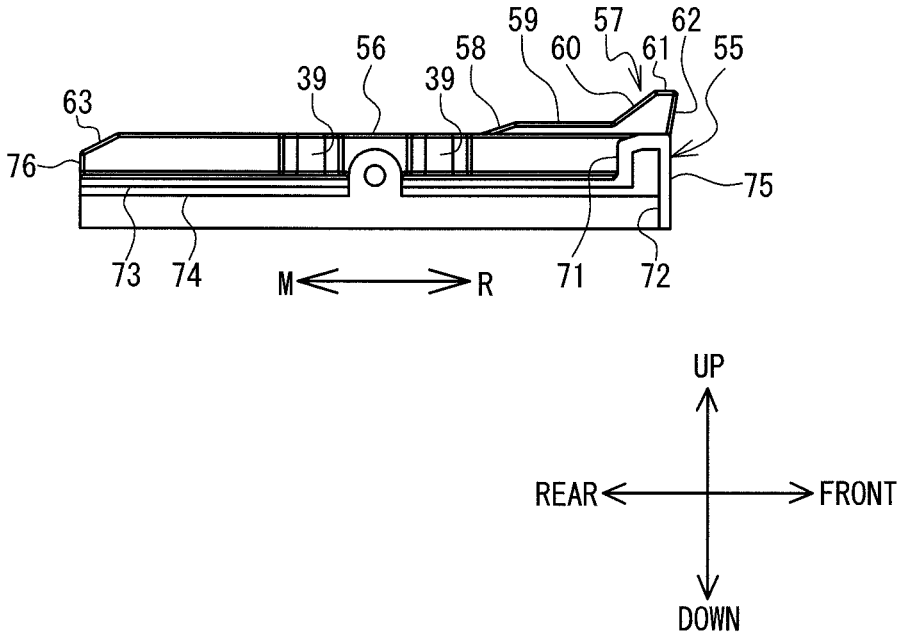
FIG. 3B is a left side view of the coupling portion of the embroidery frame.
Figure 3C:
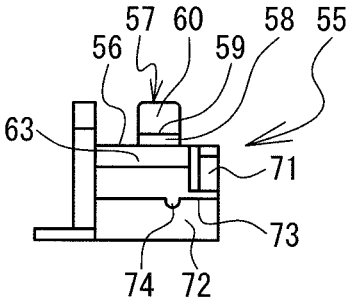
FIG. 3C is a back view of the coupling portion.
Figure 3C:
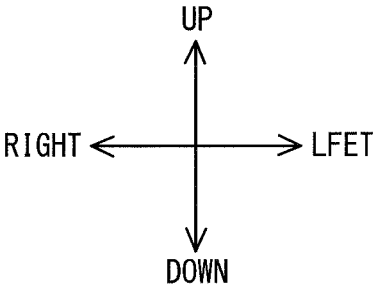

The embroidery frame 50 will be described with reference to FIG. 3A to FIG. 3C. The embroidery frame 50 includes a first frame 51, a second frame 52, and a coupling portion 55, and is configured to hold the sewing object C (refer to FIG. 1) with the first frame 51 and the second frame 52. The coupling portion 55 is a portion that is to be detachably mounted on the holder 43 of the carriage 42. The coupling portion 55 has a rectangular shape in a plan view that extends along a mounting direction M of the embroidery frame 50. The mounting direction M of the embroidery frame 50 in present embodiment is toward the rear. A removing direction R of the embroidery frame 50 in present embodiment is toward the front. The coupling portion 55 is coupled to the left portion of the second frame 52. The coupling portion 55 includes contact portions 56 and 73, a front end portion 75, and a rear end portion 76. The contact portion 56 is a portion that forms an upper surface of the rectangular coupling portion 55 that is long in the front-rear direction in a plan view. A protrusion 57, an inclined portion 63, and an identifying portion 39 are provided on the contact portion 56.

The protrusion 57 is a protrusion that protrudes farther upward than an extending surface (upper surface) of the contact portion 56 that extends from the front end toward the rear, at substantially the center in the left-right direction of the front portion of the contact portion 56. As shown in FIG. 3B, the protrusion 57 is formed in a stepped shape protruding farther upward toward the front side in a left side view. The protrusion 57 has inclined portions 58 and 60, flat portions 59 and 61, and a contact portion 62. The inclined portions 58 and 60 are portions that are inclined toward a guide portion 74, described later, side (downward) in the mounting direction M. The inclined portion 58 is provided on a rear end portion of the protrusion 57. The angle of the inclined portion 58 with respect to the contact portion 56 is an acute angle. The rear end of the inclined portion 58 is farther toward the front side than the center of the coupling portion 55 in the front-rear direction. The flat portions 59 and 61 are portions that extend substantially parallel to the extending surface of the contact portion 56. The flat portion 59 connects to the front end of the inclined portion 58. The length of the flat portion 59 in the mounting direction M is longer than the length of the inclined portion 58 in the mounting direction M. The inclined portion 60 connects to the front end of the flat portion 59. The angle of the inclined portion 60 with respect to the contact portion 56 is greater than the angle of the inclined portion 58 with respect to the contact portion 56. The flat portion 61 connects to the front end of the inclined portion 60. The length of the flat portion 61 in the mounting direction M is shorter than the length of the inclined portion 60 in the mounting direction M. The contact portion 62 is the front surface of the protrusion 57. The extending surface of the contact portion 62 is inclined slightly forward from a plane perpendicular to the extending surface of the contact portion 56, on the upper side compared to the lower side.

The inclined portion 63 is a portion that is provided on the rear end of the contact portion 56 and is inclined toward the guide portion 74, which will be described later, side (downward) in the mounting direction M. The identifying portion 39 is a protrusion that protrudes toward the left from the left surface of the contact portion 56 and is provided at a position unique to the embroidery frame 50. When the embroidery frame 50 is mounted on the holder 43 of the device 40, the sewing machine 1 can identify that the embroidery frame 50 has been attached as well as the type of the embroidery frame 50, on the basis of the position of the identifying portion 39 detected by a detector (not shown in the drawings). The contact portion 56 has the guide portion 74 on a lower surface. The guide portion 74 defines the mounting direction M of the embroidery frame 50 by contacting the holder 43 of the carriage 42. The guide portion 74 is a protrusion that extends along the longitudinal direction of the coupling portion 55 and protrudes downward.

The contact portion 73 is a portion that extends substantially parallel to the extending surface of the contact portion 56, to the left of the contact portion 56. The position of the upper surface of the contact portion 73 in the up-down direction is a position lower than the position of the upper surface of the contact portion 56. The front end portion 75 forms a front surface provided on the front end of the coupling portion 55. As shown in FIG. 3B, the left portion of the front end portion 75 has a hook shape that opens downward in a left side view. The left rear end portion of the front end portion 75 connects to the contact portion 73. The front end portion 75 extends to a position lower than the contact portion 73. The front end portion 75 includes contact portions 71 and 72. The contact portion 71 is a portion that extends upward from the front end of the contact portion 73. The contact portion 72 is a portion that extends lower than the contact portion 73, in front of the contact portion 73. The rear end portion 76 is provided substantially perpendicular to the extending surface of the contact portion 56.

The holder 43 will now be described with reference to FIG. 4A to FIG. 4D. The holder 43 is a member having a rectangular shape that is long in the front-rear direction in a plan view. As shown in FIG. 4A to FIG. 4D, the holder 43 mainly includes an attachment base 22, a lock release lever 80, an urging member 31, and a second urging member 36. The attachment base 22 has a C-shape that is open on the right side in a front view. The attachment base 22 has a first plate portion 26, a second plate portion 28, and a third plate portion 29. The first plate portion 26 is a flat plate-shaped portion facing the bed portion 11 of the sewing machine 1 when the device 40 is attached to the sewing machine 1. The first plate portion 26 forms a lower side portion of the C-shaped attachment base 22 in a front view. A groove-shaped guide portion 25 that extends parallel to the longitudinal direction of the holder 43 is provided on the first plate portion 26. The guide portion 25 is provided on the holder 43 of the carriage 42 and contacts the guide portion 74 provided on the coupling portion 55 of the embroidery frame 50 to define the mounting direction M and the removing direction R of the embroidery frame 50. The mounting direction M and the removing direction R of the embroidery frame 50 in present embodiment match the longitudinal direction of the holder 43 and the coupling portion 55.

The second plate portion 28 extends upward from the left end portion of the first plate portion 26. The second plate portion 28 is a flat plate-shaped portion facing the Y-axis movement mechanism (not shown in the drawings) of the carriage 42. The second plate portion 28 forms a left side portion of the C-shaped attachment base 22 in a front view. A cylindrical-shaped rotation shaft 27 that protrudes toward the side on which the guide portion 25 is provided (toward the right) from the extending surface of the second plate portion 28 is provided on the front portion of the second plate portion 28. The rotation shaft 27 is provided at a position facing the guide portion 25 of the carriage 42 (holder 43). A hole 19 that extends through in the left-right direction is provided in the center portion of the second plate portion 28 in the front-rear direction. A detector (not shown in the drawings) that detects the identifying portion 39 is disposed in the hole 19.

The third plate portion 29 is a flat plate-shaped portion facing the first plate portion 26. The third plate portion 29 forms an upper side portion of the C-shaped attachment base 22 in a front view. A hole 48 that passes through in the up-down direction and a protrusion 47 that protrudes in the up-down direction are lined up in the front-rear direction on a rear portion of the third plate portion 29. A pair of protrusions 45 that protrude in the up-down direction are provided lined up in the front-rear direction between a pair of holes 46 that pass through in the up-down direction, in the center portion in the front-rear direction of the third plate portion 29. There is a cutout portion 21 that is cut out in a rectangular shape in the front right portion of the third plate portion 29. There is a cutout portion 23 that is cut out from the right end toward the left on the side slightly to the rear of the center portion in the mounting direction M of the third plate portion 29.

Figure 4A:
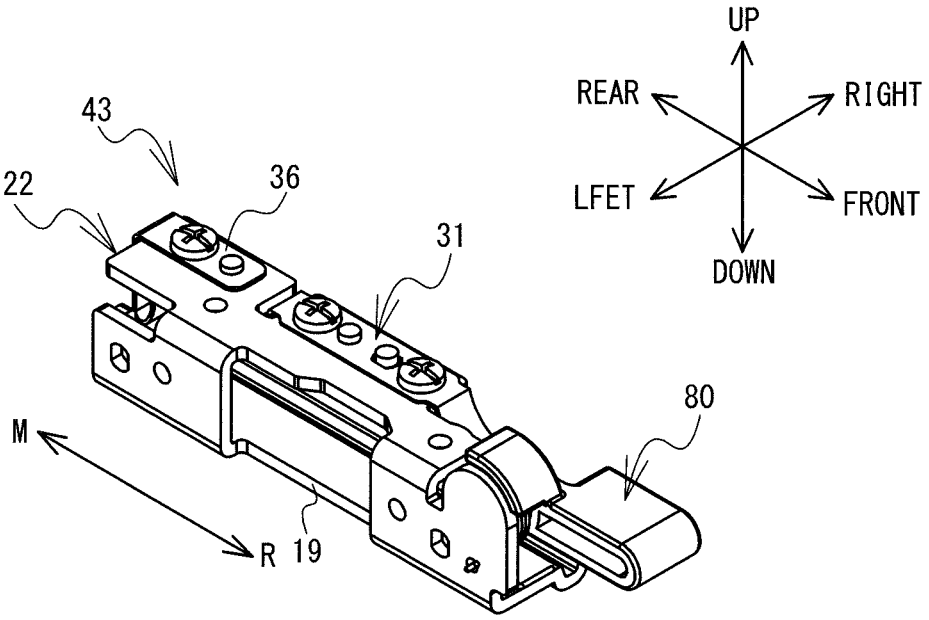
FIG. 4A is a perspective view of a holder.
Figure 4B:
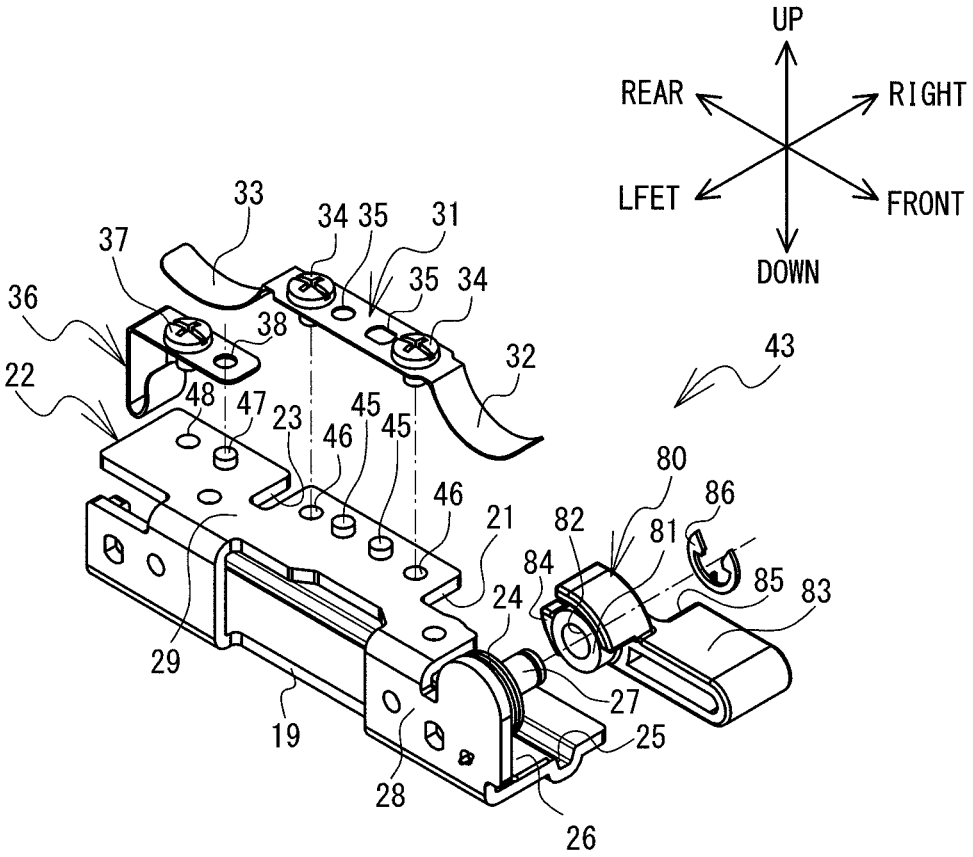
FIG. 4B is an exploded perspective view of the holder.
Figure 4C:
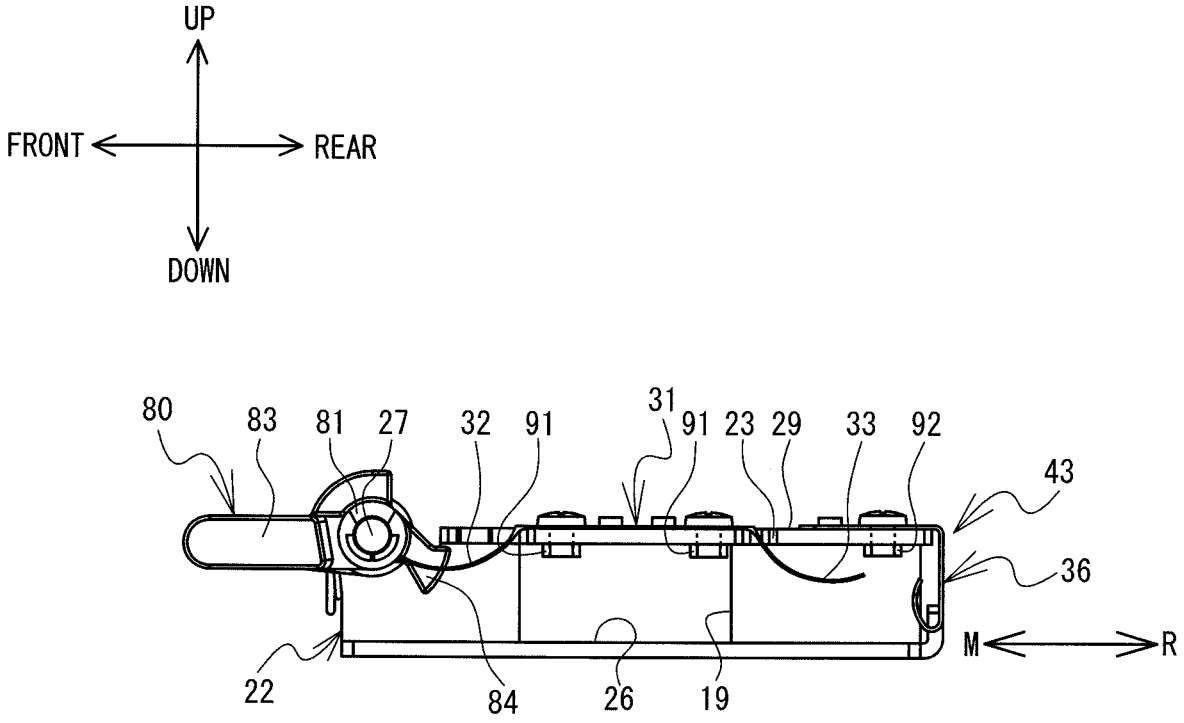
FIG. 4C is a right side view of the holder when a lock release lever is in a first position.
Figure 4D:
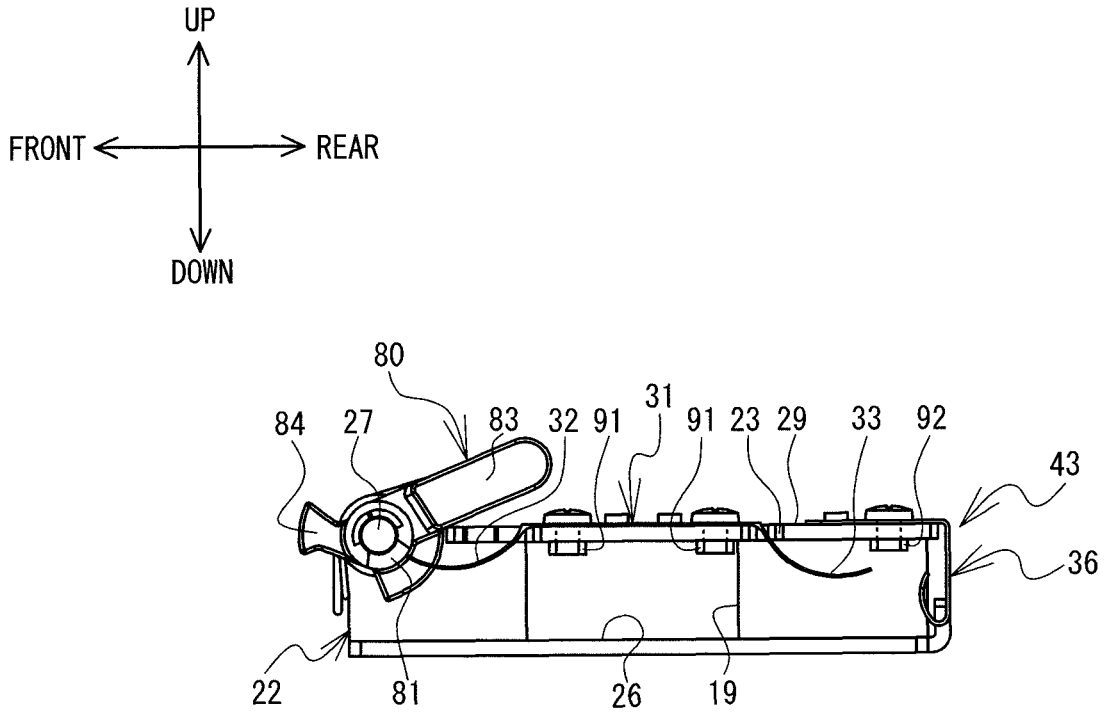
FIG. 4D is a right side view of the holder when the lock release lever is in a second position.

The lock release lever 80 is lever that is fitted over the rotation shaft 27 and can be rotated around the rotation shaft 27 to a first position shown in FIG. 4C and a second position shown in FIG. 4D. The lock release lever 80 is provided on an end portion of the holder 43 in the removing direction R. The lock release lever 80 has a base end portion 81, a hole 82, a lever portion 83, a contact portion 84, and a first restricting portion 85. The base end portion 81 is a circular portion in a side view that is provided on one end portion of the lock release lever 80. As shown in FIG. 2, the position of the right end of the base end portion 81 in the left-right direction is substantially the same as the position of the left end of the cutout portion 21 of the third plate portion 29 in the left-right direction. The base end portion 81 has the hole 82 that passes through in the left-right direction. The rotation shaft 27 is inserted through the hole 82. A retaining ring 86 is fixed to a tip end portion of the rotation shaft 27. The lever portion 83 is a bar-shaped portion that extends from the base end portion 81 of the lock release lever 80 toward the other end. The width of the lever portion 83 in the left-right direction is wider than the width of the base end portion 81 in the left-right direction. As shown in FIG. 4C, when the lock release lever 80 is in the first position, the lever portion 83 of the lock release lever 80 assumes a posture extending from the rotation shaft 27 in the removing direction R and following the extending direction of the guide portion 25. The contact portion 84 is a portion that extends from the base end portion 81 in a direction intersecting the extending direction of the lever portion 83. The contact portion 84 contacts the contact portion 71 of the coupling portion 55 and presses the embroidery frame 50 in the removing direction R as a result of the lock release lever 80 moving to a third position between the first position and the second position when the lock release lever 80 is rotated in the releasing direction toward the second position (clockwise in a right side view) from the first position while the coupling portion 55 is in a state mounted on the holder 43 of the carriage 42. As shown in FIG. 2, the contact portion 84 extends to the left side of the center of the lock release lever 80 in the left-right direction. When the coupling portion 55 of the embroidery frame 50 is mounted on the holder 43, the contact portion 84 is positioned to the left of the contact portion 56 of the coupling portion 55, and above the contact portion 73.

The first restricting portion 85 is an end portion on the base end portion 81 side of the lever portion 83, and is a portion that protrudes to the right of the base end portion 81. When the embroidery frame 50 is moved in the mounting direction M and arranged in the mounting position in the process of mounting the coupling portion 55 on the holder 43 of the carriage 42, the first restricting portion 85 moves to the first position and contacts the protrusion 57 (contact portion 62) of the coupling portion 55. The contact portion 84 of the lock release lever 80 contacts the lower surface of the third plate portion 29. The lock release lever 80 is restricted from moving counterclockwise in a right side view by the third plate portion 29. As a result, the lock release lever 80 restricts the embroidery frame 50 from moving in the removing direction R. As shown in FIG. 2, the inclined portion 60 of the protrusion 57 is positioned to the right of the rotation shaft 27 when the lock release lever 80 is in the first position.

A first urging member 24 is provided on the holder 43 of the carriage 42, and urges the lock release lever 80 in a locking direction from the second position toward the first position around the rotation shaft 27 (counterclockwise in a right side view). The first urging member 24 of present embodiment is a torsion spring that is fitted over the rotation shaft 27. The second urging member 36 is provided on the holder 43 of the carriage 42 and urges the coupling portion 55 that is mounted on the holder 43 of the carriage 42 in the removing direction R. The second urging member 36 in present embodiment is a plate spring that is bent in an L-shape in a side view, so as to have a front portion that extends in the front-rear direction and a rear portion that extends in the up-down direction. The front portion of the second urging member 36 in present embodiment extends along the third plate portion 29. A pair of holes 38 (only one is shown in FIG. 4B) that pass through in the up-down direction are provided in the front portion of the second urging member 36. The protrusion 47 of the third plate portion 29 is inserted through the hole 38 on the front side. A bolt 37 is inserted through the hole 38 on the rear side, as well as through the hole 48, and a nut 92 is fastened to the lower end of the bolt 37. The second urging member 36 is fixed to the attachment base 22 by the bolt 37 and the nut 92. The second urging member 36 is restricted from rotating relative to the attachment base 22 by the protrusion 47 that is inserted into the hole 38. The rear portion of the second urging member 36 is bent in a U-shape to the front side.

The urging member 31 is a plate spring that extends substantially parallel to the guide portion 25. The urging member 31 includes a third urging member 32, a fourth urging member 33, and four holes 35 (only two are shown in FIG. 4B). The third urging member 32 is an urging member that is provided at a position facing the guide portion 25 of the carriage 42 (holder 43), and protrudes toward the guide portion 25 side. The third urging member 32 has a shape in which the front portion of the urging member 31 is curved in a downward arc shape in a right side view. The fourth urging member 33 is provided on the second urging member 36 side (rear side) with respect to the third urging member 32, at a position facing the guide portion 25 of the carriage 42 (holder 43). The fourth urging member 33 protrudes farther toward the guide portion 25 side (downward) than the third urging member 32. The fourth urging member 33 has a shape in which the rear portion of the urging member 31 is curved in a downward arc shape in a right side view. When the coupling portion 55 is positioned in the mounting position, the third urging member 32 and the fourth urging member 33 each contact the coupling portion 55 and urge the coupling portion 55 toward the guide portion 25 side.

The four holes 35 are provided lined up in the front-rear direction in the center portion of the urging member 31 in the front-rear direction. The urging member 31 is fixed by a pair of bolts 34 and nuts 91 in a state in which the third urging member 32 is arranged in the cutout portion 21 of the third plate portion 29 of the attachment base 22, and the fourth urging member 33 is inserted through the cutout portion 23 from the upper side toward the lower side. More specifically, the pair of bolts 34 of the attachment base 22 are inserted through the frontmost- and rearmost-holes 35, and the pair of holes 46, and the lower ends of the pair of bolts 34 are fixed with the pair of nuts 91. The protrusions 45 are inserted through the remaining two holes 35.

The front end of the third urging member 32 and the rear end of the fourth urging member 33 are free ends. The third urging member 32 and the fourth urging member 33 have curved shapes that protrude downward so as to avoid hitting the rear end portion of the coupling portion 55 when the coupling portion 55 is mounted on the holder 43. The third urging member 32 and the fourth urging member 33 are separated from the first plate portion 26. When the coupling portion 55 is attached to the holder 43, the coupling portion 55 is arranged between the third urging member 32 and the fourth urging member 33, and the first plate portion 26. The pressing force from above of the third urging member 32 and the fourth urging member 33 does not interfere with the movement of the coupling portion 55 in the mounting direction M and the removing direction R, and suppresses looseness in the up-down direction when attaching and detaching the coupling portion 55.

The lock release lever 80 is configured to rotate in the locking direction to a position where the lever portion 83 contacts the third plate portion 29. The third plate portion 29 is provided on the holder 43 of the carriage 42, and comes into contact with the lock release lever 80 when the lock release lever 80 is in the first position, to restrict the lock release lever 80 from moving beyond the first position in the releasing direction. The lock release lever 80 can rotate in the releasing direction to a position where the contact portion 84 contacts the third plate portion 29.

The operation of attaching and detaching the embroidery frame 50 to and from the holder 43 will be described with reference to FIG. 5 and FIG. 6. When the embroidery frame 50 is mounted on the holder 43, the user inserts the rear end of the coupling portion 55 from the front end of the holder 43, and moves the coupling portion 55 in the mounting direction M while the guide portion 74 of the coupling portion 55 is engaged with the guide portion 25 of the holder 43. The third urging member 32 provided on the holder 43 separates from the contact portion 56 of the coupling portion 55. When the user moves the coupling portion 55 farther in the mounting direction M, the lever portion 83 comes into contact with the protrusion 57 of the coupling portion 55. The lever portion 83 is guided by the inclined portions 58 and 60, and rotates in the releasing direction (clockwise in a right side view). That is, when the embroidery frame 50 is moved in the mounting direction M in the process of mounting the coupling portion 55 on the holder 43 of the carriage 42, the lock release lever 80 comes into contact with the coupling portion 55 and rotates in the releasing direction against the urging force of the first urging member 24.

When the user moves the coupling portion 55 farther in the mounting direction M such that the coupling portion 55 is arranged in the mounting position shown in state (1), the rear end portion 76 of the coupling portion 55 comes into contact with the second urging member 36. The coupling portion 55 receives force in the removing direction R from the second urging member 36. When the coupling portion 55 is moved to the mounting position, the contact between the lever portion 83 of the lock release lever 80 and the flat portion 61 of the protrusion 57 is released, and the lever portion 83 of the lock release lever 80 rotates in the locking direction by the urging force of the first urging member 24 and moves to the first position. The first restricting portion 85 comes into contact with the contact portion 62. The holder 43 restricts the movement of the coupling portion 55 in the mounting direction M and the removing direction R, with the second urging member 36 and the first restricting portion 85. The third urging member 32 comes into contact with the flat portion 59 of the protrusion 57. The fourth urging member 33 comes into contact with the contact portion 56. The coupling portion 55 is restricted from moving in the up-down direction by the first plate portion 26, the third urging member 32, and the fourth urging member 33.

Figure 5:
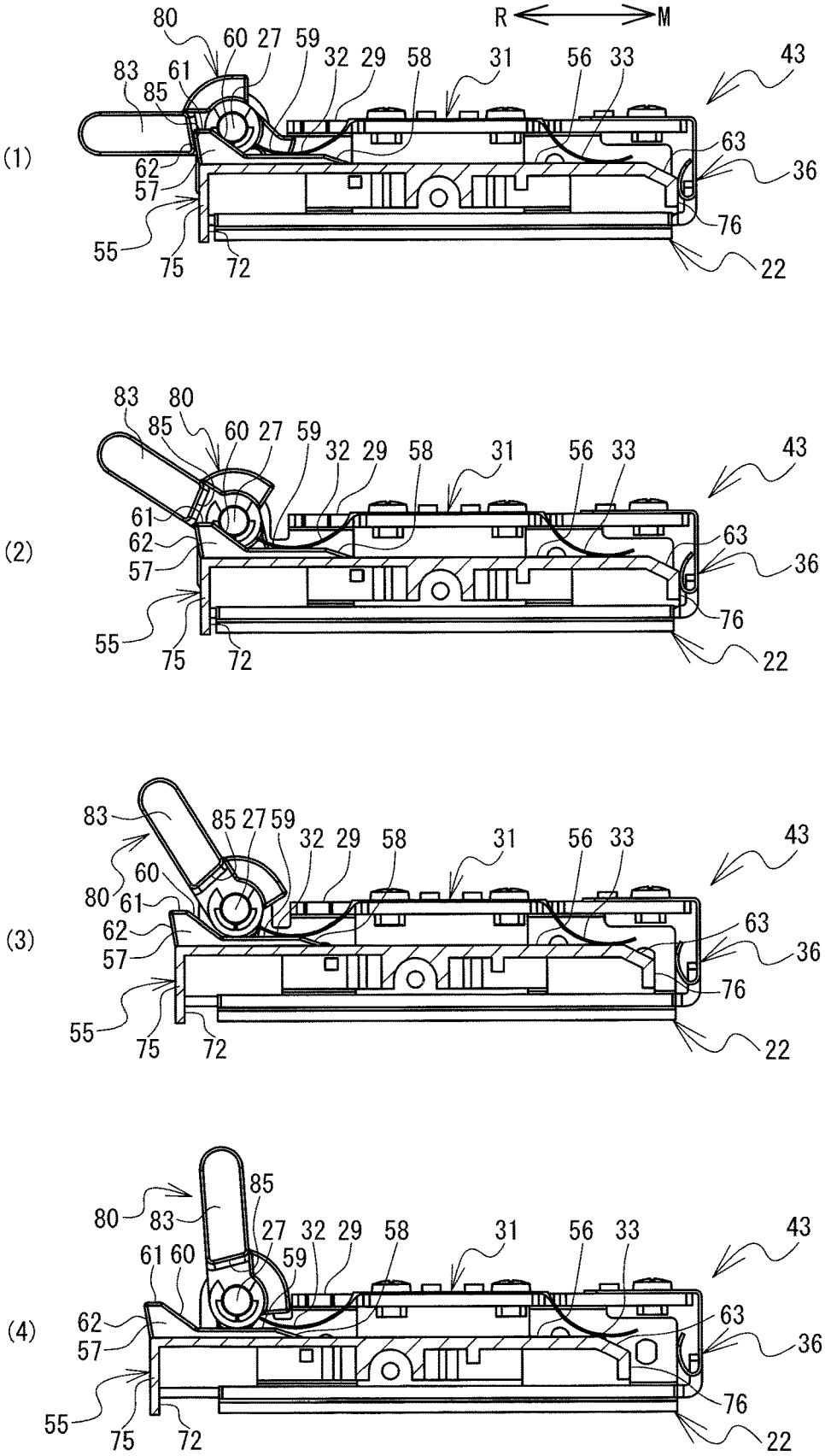
FIG. 5 is an explanatory view of an operation to remove the embroidery frame mounted on the holder (a cross-sectional view in the direction of arrows along a line B-B in FIG. 2)
Figure 6:
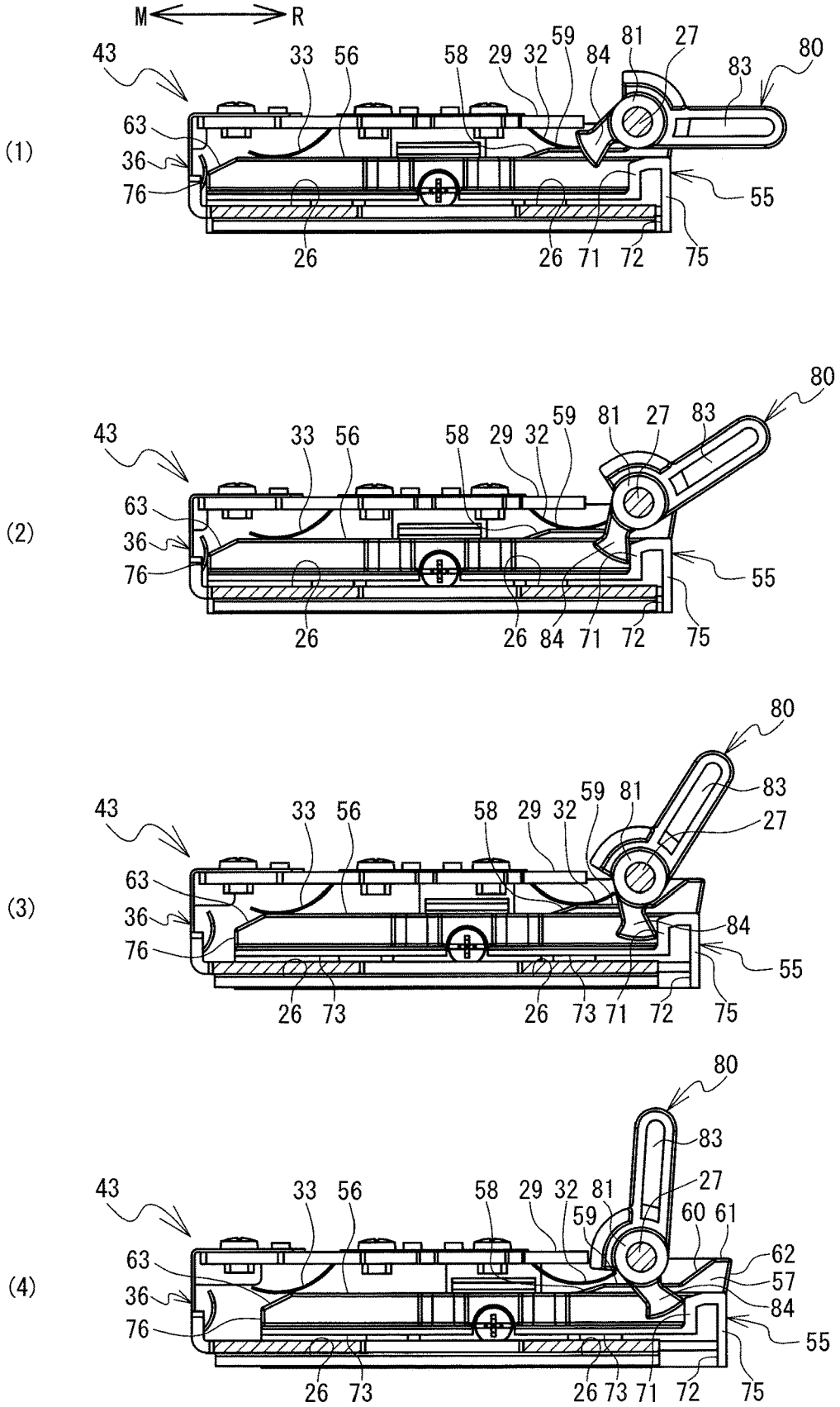
FIG. 6 is an explanatory view of an operation to remove the embroidery frame mounted on the holder (a cross-sectional view in the direction of arrows along a line A-A in FIG. 2).

As shown in FIG. 5 and FIG. 6, when removing the embroidery frame 50 from the holder 43, the user rotates the lock release lever 80 clockwise in a right side view from the first position around the rotation shaft 27. As shown in state (2), when the user moves the lock release lever 80 to the third position, the contact portion 84 of the lock release lever 80 comes into contact with the contact portion 71 of the coupling portion 55. The first restricting portion 85 of the lock release lever 80 and the contact portion 62 of the coupling portion 55 separate from each other. As shown in state (3), when the user rotates the lock release lever 80 farther in the releasing direction, the contact portion 84 of the lock release lever 80 presses the contact portion 71 of the coupling portion 55 forward, thereby moving the coupling portion 55 forward.

As shown in state (4), when the user rotates the lock release lever 80 farther in the releasing direction, the third urging member 32 separates from the flat portion 59 of the coupling portion 55. The fourth urging member 33 comes into contact with the inclined portion 63 and pushes the coupling portion 55 forward. When the user rotates the lock release lever 80 farther in the releasing direction such that the lock release lever 80 moves to the second position shown in FIG. 4D, the contact portion 84 of the lock release lever 80 separates from the coupling portion 55. The third urging member 32 and the fourth urging member 33 separate from the coupling portion 55 (the protrusion 57 and the contact portion 56). Because the coupling portion 55 is separated from the third urging member 32 and the fourth urging member 33, the user can move the coupling portion 55 in the removing direction R with comparatively little force, and remove the embroidery frame 50 from the holder 43.

According to the device 40, the user can both release the movement restriction on the coupling portion 55 by the first restricting portion 85, and push the embroidery frame 50 in the removing direction R, by operating the lock release lever 80. In other words, the device 40 can simplify the operation of removing the embroidery frame 50 from the device 40, compared to an embroidery frame transport device of known art in which the release of the lock of the embroidery frame with respect to the holder 43 is performed separately from the operation to pull out the embroidery frame. The contact portion 84 and the first restricting portion 85 are provided on the lock release lever 80, so the number of parts can be reduced compared to a case where both are separate members. As shown in FIG. 2, the first restricting portion 85 is arranged on the right portion of the lock release lever 80 and the contact portion 84 is arranged on the left portion of the lock release lever 80 in the left-right direction of the lock release lever 80 in present embodiment. According to this kind of configuration, the configuration of the lock release lever 80 of the device 40 can be relatively simple. The user can confirm whether the embroidery frame 50 is mounted on the holder 43 of the carriage 42 according to whether the lock release lever 80 is in the first position.

The device 40 includes the first urging member 24 and the second urging member 36. The first urging member 24 is provided on the holder 43 of the carriage 42, and urges the lock release lever 80 in the locking direction from the second position toward the first position around the rotation shaft 27. The second urging member 36 is provided on the holder 43 of the carriage 42, and urges the coupling portion 55 that is mounted on the holder 43 of the carriage 42 in the removing direction R. The lock release lever 80 comes into contact with the coupling portion 55 when the embroidery frame 50 is moved in the mounting direction M in the process of mounting the coupling portion 55 on the holder 43 of the carriage 42. The lock release lever 80 rotates in the releasing direction against the urging force of the first urging member 24. When the coupling portion 55 is moved to the mounting position, the contact between the lock release lever 80 and the flat portion 61 of the protrusion 57 of the coupling portion 55 is released, and the lock release lever 80 rotates to the first position by the urging force of the first urging member 24. The holder 43 of the carriage 42 restricts the movement of the coupling portion 55 in the mounting direction M and the removing direction R, with the second urging member 36 and the first restricting portion 85. According to the device 40, the user can mount the embroidery frame 50 on the holder 43 of the carriage 42 of the device 40 and restrict the movement of the embroidery frame 50 in the mounting direction M and the removing direction R by the simple operation of moving the coupling portion 55 of the embroidery frame 50 in the mounting direction M and positioning the coupling portion 55 in the mounting position.

When the lock release lever 80 is in the first position, the third plate portion 29 of the device 40 comes into contact with the lock release lever 80, restricting the lock release lever 80 from moving beyond the first position in the releasing direction. Therefore, the device 40 can reliably avoid the lock release lever 80 moving beyond the first position in the releasing direction.

The lock release lever 80 is provided on the end portion of the holder 43 in the removing direction R. When the lock release lever 80 is arranged in the first position, the first restricting portion 85 comes into contact with the contact portion 62 that is the end portion of the coupling portion 55 in the removing direction R. The lock release lever 80 includes the lever portion 83. When the lock release lever 80 is in the first position, the lever portion 83 assumes a posture extending from the rotation shaft 27 in the removing direction R and following the extending direction of the guide portion 25. The first restricting portion 85 is provided on the end portion on the rotation shaft 27 side of the lever portion 83. Therefore, according to the device 40, the user can easily operate the lock release lever 80. The device 40 can prevent the lock release lever 80 from interfering with sewing during embroidery sewing. Moreover, the device 40 can clamp the coupling portion 55 in the front-rear direction and thus restrict movement of the coupling portion 55 in the mounting direction M and the removing direction R, by the simple configuration of the second urging member 36 and the lock release lever 80.

The device 40 includes the third urging member 32 and the fourth urging member 33. The third urging member 32 is provided at a position facing the guide portion 25 and protrudes toward the guide portion 25 side. The fourth urging member 33 is provided on the second urging member 36 side with respect to the third urging member 32, at a position facing the guide portion 25. The fourth urging member 33 protrudes farther toward the guide portion 25 than the third urging member 32. When the coupling portion 55 is positioned in the mounting position, the third urging member 32 and the fourth urging member 33 each come into contact with the contact portion 56 of the coupling portion 55, and urge the coupling portion 55 toward the guide portion 25 side. Therefore, according to the device 40, when the coupling portion 55 is mounted on the holder 43 of the carriage 42, the coupling portion 55 can be pressed toward the guide portion 25 side by the third urging member 32 and the fourth urging member 33.

When the lock release lever 80 is rotated from the first position to the second position while the coupling portion 55 is positioned in the mounting position, the third urging member 32 and the fourth urging member 33 each separate from the coupling portion 55. According to the device 40, when the lock release lever 80 is rotated to the second position, the embroidery frame 50 does not receive force from either the third urging member 32 or the fourth urging member 33 of the device 40, so the user can easily remove the embroidery frame 50 from the device 40 with relatively little force.

The embroidery frame 50 includes the first frame 51, the second frame 52, and the coupling portion 55. The coupling portion 55 includes the guide portion 74 and the inclined portions 58 and 63. According to the embroidery frame 50, when the embroidery frame 50 is mounted on the device 40, the embroidery frame 50 can be moved smoothly with respect to the carriage 42. As shown in state (4), when the fourth urging member 33 is contacting the inclined portion 63, the coupling portion 55 receives force toward the removing direction R from the fourth urging member 33. Therefore, with the device 40, the embroidery frame 50 can be moved in the removing direction using the urging force of the third urging member 32 and the fourth urging member 33.

An embroidery frame transport device and an embroidery frame of the present disclosure are not limited to the above described embodiment, and various changes may be made without departing from the spirit and scope of the present disclosure. For example, the following modifications (A) and (B) may be added as appropriate.

(A) The configuration of the sewing machine 1 may be amended as appropriate. The sewing machine 1 may be an industrial sewing machine or a multi-needle sewing machine. It is sufficient that the device be such that the holder is able to move relative to the needle bar in a first direction and a direction intersecting the first direction. The device 40 may be integrally formed with the sewing machine 1. The embroidery frame that can be mounted on the device 40 need only include the first frame, the second frame, and the coupling portion, and may be an embroidery frame that clamps the sewing object in the up-down direction, for example. The size and shape of the embroidery frame may be changed as appropriate. The configuration of the coupling portion of the embroidery frame may be changed as appropriate. The shape and position of the recessed portion of the coupling portion may be changed as appropriate.

(B) At least one of the first urging member 24 and the second urging member 36 may be omitted, or the configuration thereof may be changed. The second restricting portion may be omitted as necessary, or the configuration thereof may be changed. For example, the second restricting portion may be a protrusion that protrudes to the right from the second plate portion 28 of the attachment base 22 and contacts the lower surface of the lever portion 83 when the lock release lever 80 is in the first position. The arrangement position of the lock release lever 80 may be changed as appropriate. The extending direction of the lever portion 83 when the lock release lever 80 is in the first position may be changed as appropriate. At least one of the third urging member 32 and the fourth urging member 33 may be omitted, or the configuration and material and the like thereof may be changed. The rotatable range of the lock release lever 80 may be changed as appropriate. When the lock release lever 80 is in the second position, at least one of the third urging member 32 and the fourth urging member 33 may contact the coupling portion 55 of the embroidery frame 50. One of the inclined portions 58 and 63 of the embroidery frame 50 may be omitted, or the inclined portions 58 and 63 may be continuous.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame transport device comprising:

a carriage configured to detachably mount with a coupling portion of an embroidery frame;

a guide portion provided on the carriage, the guide portion being configured to define a mounting direction and a removing direction of the embroidery frame;

a rotation shaft provided at a position facing the guide portion of the carriage; and a lock release lever including a first restricting portion and a contact portion, the lock release lever being configured to rotate to a first position and a second position around the rotation shaft, the first restricting portion contacting the coupling portion to restrict the embroidery frame from moving in the removing direction by moving to the first position when the embroidery frame is moved in the mounting direction in a process of mounting the coupling portion on the carriage, and the contact portion contacting the coupling portion and pressing the embroidery frame in the removing direction as a result of the lock release lever moving to a third position between the first position and the second position when the lock release lever is rotated in a releasing direction toward the second position from the first position while the coupling portion is in a state mounted on the carriage.

2. The embroidery frame transport device according to claim 1, further comprising:

a first urging member configured to urge the lock release lever in a locking direction toward the first position from the second position around the rotation shaft, the first urging member being provided on the carriage; and a second urging member configured to urge the coupling portion mounted on the carriage in the removing direction, the second urging member being provided on the carriage, wherein the lock release lever contacts the coupling portion and rotates in the releasing direction against the urging force of the first urging member when the embroidery frame is moved in the mounting direction in the process of mounting the coupling portion on the carriage, and rotates to the first position by the urging force of the first urging member and restricts the coupling portion from moving in the mounting direction and the removing direction with the second urging member and the first restricting portion, when the coupling portion is moved to a mounting position.

3. The embroidery frame transport device according to claim 2, further comprising:

a second restricting portion configured to restrict the lock release lever from moving in the releasing direction beyond the first position by abutting against the lock release lever when the lock release lever is in the first position, the second restricting portion being provided on the carriage.

4. The embroidery frame transport device according to claim 1, wherein the lock release lever further includes a lever portion configured to assume a posture extending in the removing direction from the rotation shaft and following an extending direction of the guide portion when the lock release lever is in the first position, and the first restricting portion comes into contact with an end portion in the removing direction of the coupling portion.

5. The embroidery frame transport device according to claim 4, wherein the first restricting portion is provided on an end portion on the rotation shaft side of the lever portion, the first restricting portion being configured to come into contact with the end portion in the removing direction of the coupling portion.

6. The embroidery frame transport device according to claim 1, further comprising:

a third urging member provided at a position facing the guide portion of the carriage, the third urging protruding toward the guide portion side; and a fourth urging member provided on the second urging member side with respect to the third urging member, at a position facing the guide portion of the carriage, the fourth urging member protruding farther toward the guide portion side than the third urging member, wherein when the coupling portion is positioned in the mounting position, the third urging member and the fourth urging member each contact the coupling portion and urge the coupling portion toward the guide portion side.

7. The embroidery frame transport device according to claim 6, wherein the third urging member and the fourth urging member each separate from the coupling portion when the lock release lever is rotated from the first position to the second position in a state in which the coupling portion is positioned in the mounting position.

* * * * *